US006406265B1

(12) United States Patent
Hahn et al.

(10) Patent No.: US 6,406,265 B1
(45) Date of Patent: Jun. 18, 2002

(54) COMPRESSOR DIAGNOSTIC AND RECORDING SYSTEM

(75) Inventors: Greg Hahn; Zili Sun; Carlos Zamudio, all of Arkadelphia; Jason Hugenroth, Hope; Thomas Barito, Arkadelphia, all of AR (US); James W. Bush, Skaneateles, NY (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/553,836

(22) Filed: Apr. 21, 2000

(51) Int. Cl.[7] ..... F04B 49/06
(52) U.S. Cl. ..... 417/19; 417/32; 417/44.1
(58) Field of Search ..... 62/505; 417/19, 417/32, 44.1, 44.2, 44.3, 45, 18; 371/29; 418/55.3

(56) References Cited

U.S. PATENT DOCUMENTS 4,431,380 A * 2/1984 Utter ..... 418/55.3
4,521,885 A * 6/1985 Melocik et al. ..... 371/29
4,667,480 A * 5/1987 Bessler ..... 417/32
4,765,150 A * 8/1988 Persem ..... 417/45
5,350,039 A * 9/1994 Voss et al. ..... 62/505
6,017,192 A * 1/2000 Clack et al. ..... 417/18
6,041,605 A * 3/2000 Heinrichs ..... 62/505
6,112,535 A * 9/2000 Hollenbeck ..... 62/505

* cited by examiner

*Primary Examiner*—Michael Koczo
(74) *Attorney, Agent, or Firm*—Carlson, Gaskey & Olds

(57) ABSTRACT

A compressor diagnostic system incorporates a control which receives a plurality of data streams about various operational features of the compressor. As an example, both temperature and pressure of the suction and discharge refrigerant are taken and sent to the control. Moreover, information with regard to the power being supplied to the motor is taken and stored. All of this information is utilized at a control which compares the information to expected values and determines a fault based upon the evaluation. Moreover, in another feature of this invention, much of this data is stored, and maintained at the compressor. In the event of a compressor failure, this stored information will provide a maintenance worker with a good indication of why the compressor failed.

8 Claims, 2 Drawing Sheets

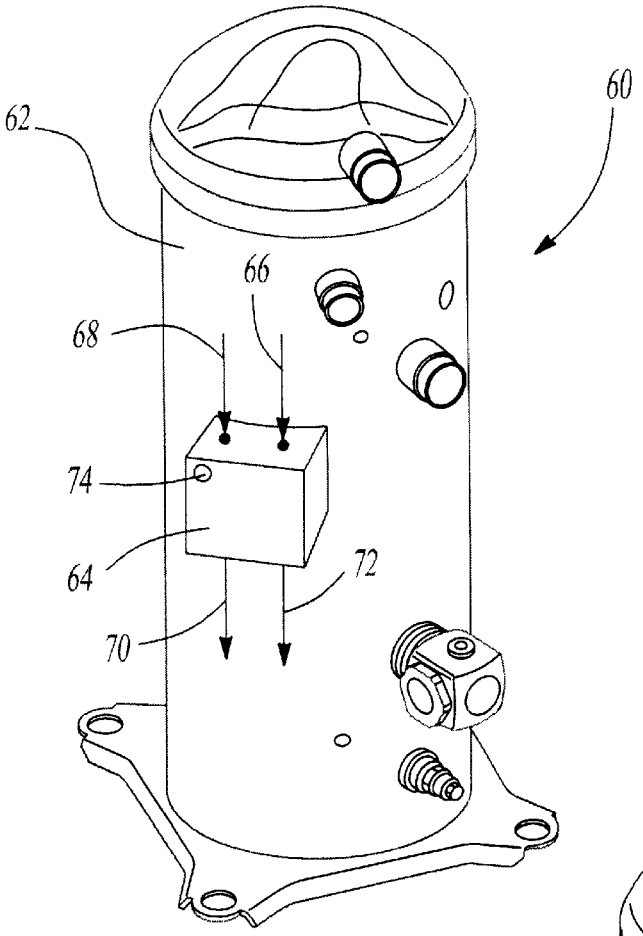
Fig-2
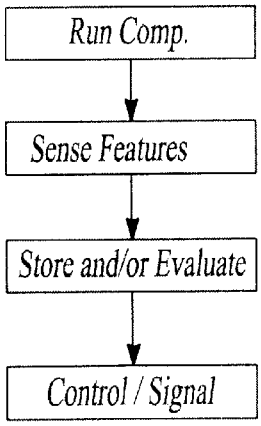
Fig-4
Fig-3
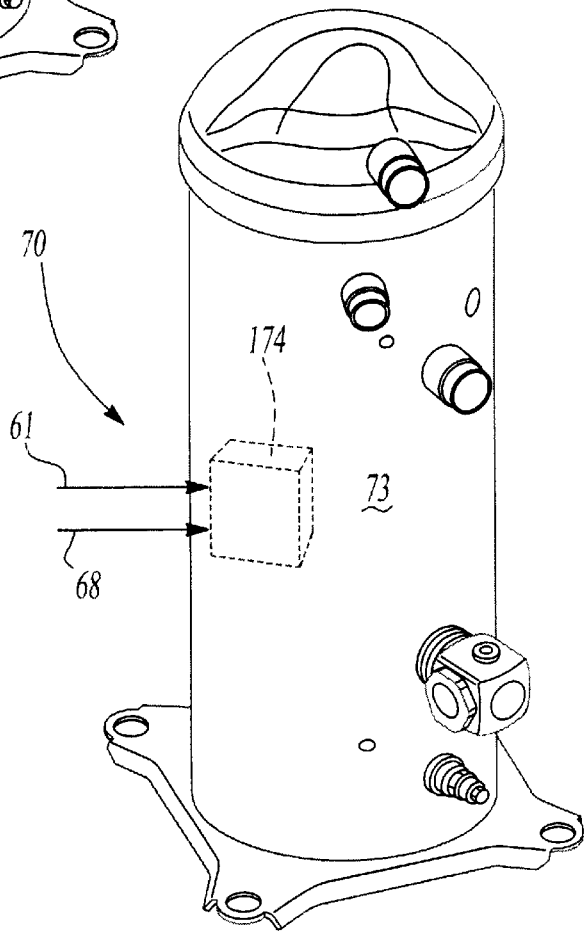

COMPRESSOR DIAGNOSTIC AND RECORDING SYSTEM

BACKGROUND OF THE INVENTION

This invention relates to a system which interprets compressor operational factors, and monitors these factors to identify irregularities. Moreover, the system stores the factors, thus providing a record.

Compressors are utilized to compress a refrigerant as part of a refrigerant cycle in cooling systems. Modern compressors for refrigerant compression are typically enclosed in a sealed housing. The compressors are driven by a motor which is driven by a single phase or a three phase power supply. Compressors operate under many extreme conditions. Some compressors have relatively complex operational parts. In one popular modern type compressor, two spiral scroll wraps orbit relative to each other to compress entrapped refrigerant. While scroll compressors are gaining wide popularity, they also are subject to design challenges. As an example, if the compressor is not optimally designed, there is a possibility of the scroll members orbiting in an improper "reverse" direction at shut down. Moreover, if the compressor is improperly wired, such reverse rotation can occur.

Other problems occur with compressors generally, but raise particular concerns in scroll compressors. Each type of compressor has specific vulnerability situations. As an example, an overcharge of refrigerant or low charge of refrigerant can be detrimental. The operation of compressors generally for refrigerant cycles have many additional challenges. As one example, stalling of the motor can indicate various problems. Also, a problem with other aspects of the refrigerant system can be identified at the compressor. As an example, if the outdoor fan fails, there will be potential increased temperatures which can be sensed at the compressor.

To date, compressors have typically been manufactured with a plurality of protection devices at each of the various components which are to be protected. As an example, the electric motor for driving a sealed compressor is typically provided with a protection switch which is actuated if a predetermined temperature is reached to stop the motor. Moreover, various protection valves are incorporated into the compressor members, and in particular, the scroll members, and are actuated under certain circumstances.

It would be desirable to minimize and simplify the number of protection devices incorporated into a compressor. Moreover, when a compressor does fail, the manufacturer would like to have some indication of why the compressor failed. To date, the manufacturer can only make interpretations of the likely cause of failure.

SUMMARY OF THE INVENTION

In a disclosed embodiment of this invention, a control receives signals relating to a number of operational factors in a compressor. Preferably, the discharge temperature and pressure, the suction temperature and pressure, and the power to the motor are all sensed. The control may also receive an indication of other temperatures, such as the temperature in an oil sump for the compressor.

All of these factors are sent to the control, which is preferably a microprocessor based control. The microprocessor based control is designed to interpret these various factors and compare the sensed factors to predetermined minimums, maximums, relationships, at the earliest etc. to determine a fault condition. Moreover, the control is preferably provided with a memory that is able to store previously read factors. The memory serves two functions. First, a "trend" in any of the factors can be identified. As an example, if one of the sensed temperatures is gradually increasing over time, this may be indicative of a "slow leak" in the system, or other slowly approaching fault problem.

In addition, the memory stores the sensed information for later retrieval. Thus, should the compressor fail, a maintenance worker can access the information from the control and have a very good indication of why the particular compressor failed. This function of the memory may be "short term." That is, it may be only a very recent time period which is stored in the memory. On the other hand, the memory could be over a very long period of time. Further, the memory may only store "feature" information. As an example, the memory may be configured to only store a high and a low of each of the features for each calendar day. Alternatively, the memory could also be designed such that it only stores the previous time, such as two days. The previous two days would provide the control with the ability to identify trends, but would not require an undue amount of memory. Moreover, if the compressor fails, the memory would still store the most recent feature information, and thus should provide an indication of why the failure occurred.

These and other features of the present invention can be best understood from the following specification and drawings, the following which is a brief description.

BRIEF DESCRIPTION OF THE DRAWINGS

FIG. 2 shows a view of one embodiment of this invention.

FIG. 3 shows an alternative embodiment, somewhat schematically.

FIG. 4 is a general flow chart.

DETAILED DESCRIPTION OF A PREFERRED EMBODIMENT

Figure 1:
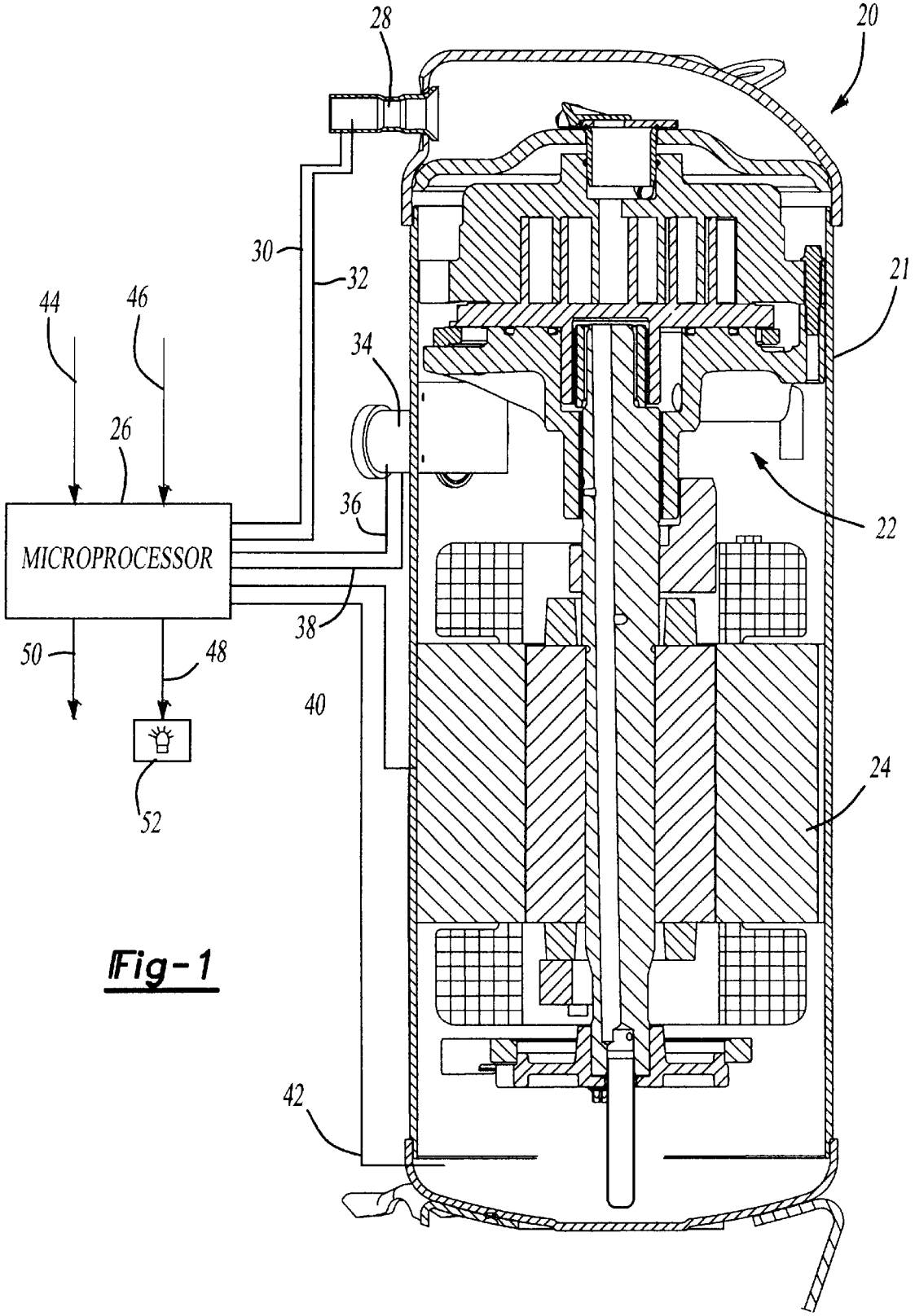
FIG. 1 is a schematic view of a sealed compressor.

A sealed compressor 20 is illustrated in FIG. 1. It should be understood that compressor 20 is received within a sealed housing 21, and is preferably incorporated into a refrigerant cycle, such as are typically found in air conditioning or other cooling cycles.

A compressor pump unit 22 is shown as a scroll compressor. A motor 24 drives compressor pump unit 22. A control 26 receives a number of signals on operation of the compressor. As shown, all of the signals can be taken from external locations in the compressor. As an example, a discharge tube 28 can be provided with a temperature sensor 30 and a pressure sensor 32. The outputs of the sensors 30 and 32 are delivered to the control 26. A suction tube 34 can be provided with a suction temperature sensor 36 and a suction pressure sensor 38. A control line 40 to the motor can be operable to stop operation of the motor. A sump temperature sensor 42 can be positioned adjacent a lower end of the housing 21, where it will be in contact with the temperature that is sensed from the housing 21 from oil in the sump of the compressor. The temperature of the oil in the sump is indicative of the temperature of other components within the housing, and in particular, the components in the pump unit 22. Inputs 44 and 46 are from the power being delivered to the motor 24. These may be current and voltage inputs. Preferably, there are low voltage control signals, and not the full power. Also, sensors could detect the motor winding temperatures, the scroll members temperature, and other internal characteristics.

A first line 48 leads from the control 26 to a signal 52. A second line 50 may lead to some other system, such as a control for shutting down operation of an associated refrigerant cycle.

The microprocessor control 26 operates to take in the various signals, and apply those signals to predetermined limits, etc. If one of the monitored features is approaching a limit, then the microprocessor 26 may indicate that a fault is occurring and may actuate the light 52, or may take other action such as stopping the motor 24.

The control 26 can perform a variety of analyses on the sensed features. Further, by storing the several features over a brief period of time, the control 26 can identify "trends." As an example, if the temperature from the discharge tube sensor 30 gradually increases over a period of time and is approaching a limit, then a determination may be made that some problem is occurring within the refrigerant cycle.

Examples of various conditions which may be monitored by the microprocessor 26 include looking for an overcharge of refrigerant. Suction temperature and suction pressure may be monitored, and if they are outside a predetermined envelope, an overcharge of refrigerant may be identified. The signal light 52 can have a number of lights such that a particular problem can be identified. Alternatively, a fault code such as have been used in vehicles could be incorporated. That is, 001 implies one fault, 010 means another, etc.

A low charge of refrigerant can also be identified by reference to the suction temperature or pressure or the discharge temperature or pressure. The compressor pump unit operating at too high of a temperature can be sensed by any one of the temperatures readings 30, 36 or 42. The occurrence of reverse running is typically found in combination with an increased temperature at any one of the locations 30, 36 and 42. A system failure, such as a failure of the outdoor fan, is identified by hot temperatures and high pressures. Compressors are often provided with a pressure relief valve to relieve undesirably high pressures at the discharge area of the compressor. However, it may be possible to eliminate such valves by incorporating the control 26 which will instead identify the undesirably high pressure, and stop operation of the compressor, or otherwise identify the occurrence of the fault.

Further, information from the lines 44 and 46 on the operation of the electrical characteristics of the motor is also important. Such operation can show the occurrence of stalling, wherein the load may be high but the voltage low. Further, other aspects of the motor control will benefit from monitoring the current and voltage.

In sum, a microprocessor control 26 can be associated with a compressor, which is preferably a scroll compressor. The control is operable to monitor on an ongoing basis various features, and compare those monitored features to particular boundaries, etc., and is then able to identify an oncoming fault. Although several faults and several features are listed in this application, it should be understood that a system within this invention need not look at the specific features disclosed, nor is it limited to only those disclosed features. What is disclosed above, is disclosed by way of example, and many other features and types of faults to be identified will come within the scope of this invention. A worker in this art would be able to identify other conditions that could be monitored by looking at certain features.

In addition, the microprocessor control 26 may also be provided with appropriate storage such that it can store the features which are monitored.

As an example, FIG. 2 shows a system 60 wherein a compressor housing 62 receives a control 64 on an outer surface. The control 64 can be designed to provide the function of the control 26. As shown, there are power inputs 66 and 68 and output 70 and 72 as in the prior embodiment. The control 64 is operable to store information with regard to the monitored features. An input jack 74 is shown schematically. A worker in this art can use this jack to access the stored information with regard to the operational features of the compressor 60. Thus, the control 64, by storing the information from the various sensors is able to provide a maintenance worker with a complete record of the operational history of the inventive compressor. Now, should the compressor break, the maintenance worker will be able to identify the conditions leading up to the time of failure.

FIG. 3 shows another embodiment 70, which is similar to the embodiment 60 of FIG. 2. However, the control 174 is mounted within the compressor housing 73 in this embodiment. Again, the system is provided with appropriate inputs and outputs as in the prior embodiments.

The controls of FIGS. 2 and 3 may be utilized to store all of the information sensed over a long period of time from the several sensors. Alternatively, the controls only need store a particular piece of "recent history" with regard to the operation of the compressor. Thus, if the control only stores the previous two days, then at the time of failure there would be two days of information. This will greatly reduce the required memory necessary to perform this function.

In addition, the memory could only store highlights of a particular period of time. Thus, the memory might store for each of the features a particular high and particular low for each day. The present invention is not limited to any particular algorithm or structure for storing the information, but rather, extends to the concept of utilizing such storage information, and such diagnostic information, as is disclosed above in a compressor, and in particular, for a scroll compressor in a refrigerant cycle. Based upon the above description, a worker in this art could identify appropriate control hardware and software.

As shown in the flow chart of FIG. 4, the present invention includes the method of running a compressor, and sensing features during the running of the compressor. Those features can then be stored. The features are also evaluated by a control. The control is preferably a microprocessor based, but other known electronic controls capable of analyzing and storing information could also be utilized. The features as stored can be extremes for a given time period, all of the information received, or simply the more recent information.

The features as sensed can be simply compared to extremes, or they can be compared to envelopes. Moreover, the evaluation can consist of looking for trends in the features. The particular envelopes, extremes, and ways of identifying what would be a trend that caused concern are within the skill of a worker in this art. This application is directed to a system and method which is able to properly analyze that information, however, a worker in the compressor art would recognize the types of conditions which are identified by a particular feature data.

The system then will decide whether a fault is occurring. As used in this context, the fault could be an upcoming fault as opposed to an immediate fault. If a fault is detected, then some warning is sent. The warning could be a signal warning such a light or sound. Alternatively, by the term "warning", this invention would also cover simply shutting down the motor.

Preferred embodiments of this invention have been disclosed, however, a worker in this art would recognize that certain modifications would come within the scope of this invention. For that reason, the following claims should be studied to determine the true scope and content of this invention.

What is claimed is:

1. A sealed compressor comprising:

a housing enclosing a compressor pump unit and a motor for driving said compressor pump unit;

a microprocessor control for determining fault conditions, said control being provided with data with regard to several operational features of said compressor, and said control storing said data in a memory, said control and said memory being mounted on an outer surface of said housing, and being accessible to a worker to retrieve said data at a later point in time.

2. A compressor as recited in claim 1, wherein said features include suction and discharge information of said compressor, and further information with regard to the power being supplied to said motor.

3. A compressor as recited in claim 1, wherein said compressor pump unit is a scroll compressor.

4. A compressor as recited in claim 1, wherein sensors are provided to sense temperature and pressure at a discharge tube, and temperature and pressure at a suction tube, and supplies said temperature and pressure information from both suction and discharge to said control.

5. A compressor as recited in claim 1, wherein said operational features include pressure information.

6. A compressor as recited in claim 1, wherein said operational features include temperature information.

7. A compressor as recited in claim 1, wherein said data includes a fault code with numbers indicative of a particular fault.

8. A compressor as recited in claim 1, wherein said motor is stopped if said data in indicative of a particular fault.

* * * * *